United States Patent [19]

Bokelmann

[11] 4,146,350

[45] Mar. 27, 1979

[54] METHOD AND APPARATUS FOR MANUFACTURING SOLID BODIES

[75] Inventor: Horst Bokelmann, Bad Wildungen, Fed. Rep. of Germany

[73] Assignee: Metzeler Schaum GmbH, Fed. Rep. of Germany

[21] Appl. No.: 820,353

[22] Filed: Jul. 29, 1977

[30] Foreign Application Priority Data

Jul. 30, 1976 [DE] Fed. Rep. of Germany ..... 2634224

[51] Int. Cl.[2] ..... B23B 35/00; B23B 39/22

[52] U.S. Cl. ..... 408/1 R; 408/41; 142/1; 144/150; 144/219

[58] Field of Search ..... 408/1 R, 37, 41, 40, 408/58, 62, 227; 142/1; 144/2 H, 322, 325, 150, 219

[56] References Cited

U.S. PATENT DOCUMENTS

| | | | |
|---|---|---|---|
| 317,131 | 5/1885 | Hartigan | 144/150 |
| 389,057 | 9/1888 | Clark | 144/150 |
| 681,294 | 8/1901 | Bliss | 408/41 |
| 3,266,199 | 8/1966 | Bryson | 408/37 |
| 3,633,583 | 1/1972 | Fishbein | 408/227 |
| 3,690,780 | 9/1972 | Bjelland et al. | 408/58 |

*Primary Examiner*—Leonidas Vlachos
*Attorney, Agent, or Firm*—Steinberg & Blake

[57] ABSTRACT

A method and apparatus for forming solid bodies by removing material from solid workpieces. A workpiece is situated between oppositely rotating tools which remove material from the workpiece, these tools having hollow interiors facing each other and each conforming to the configuration of one half of the finished body. The hollow interiors of the tools have teeth for removing material from the workpiece, and while the tools are rotated oppositely the distance therebetween is due so that from the workpiece a body is gradually formed, this body finally becoming almost completely enclosed within the hollow interiors of the tools, whereupon the latter have the distance therebetween increased so that the body formed thereby can be removed. These tools are adapted to form from a workpiece bodies of full circular or ring-shaped configuration, and the hollow interiors of the tools are provided with raised teeth similar to file teeth, for removing material from a workpiece. In addition, each tool is formed with openings extending outwardly from its hollow interior so that the material removed by the tool from the workpiece can travel outwardly through these openings.

14 Claims, 5 Drawing Figures

METHOD AND APPARATUS FOR MANUFACTURING SOLID BODIES

BACKGROUND OF THE INVENTION

The invention relates to methods and apparatus for manufacturing solid bodies, preferably of spherical or ring-shaped configuration, from a workpiece the material of which is removed in order to form the solid bodies. These workpieces preferably take the form of bars, plates, or blocks, and the workpiece is situated between a pair of tools which remove material from the workpiece to form a body of the above type therefrom.

Thus, the present invention relates to a method and apparatus for forming solid bodies of the above type by removing material from a workpiece with a pair of tools which are displaced toward each other while operating on the workpiece, these tools being displaced toward each other along a common axis.

With a method and apparatus of the above type spherical bodies, balls, rings, and the like are manufactured from a workpiece by removing material therefrom. Such a workpiece is preferably made of a suitable plastic, including foamed plastics, although it is also possible to utilize the invention in connection with workpieces made of natural or synthetic rubber, wood, ivory, or the like.

In connection with the state of the art, reference may be made to German Pat. No. 22,38,020, according to which a preferably square-shaped workpiece is rotated about a predetermined axis while material thereof is removed in order to form a circular surface. The tool which operates on this workpiece has an axis passing centrally and perpendicularly through the center of its cutting surface, and the rotation axis of the workpiece extends perpendicularly across this tool axis. The known apparatus disclosed in the above patent includes cylindrically shaped hollow cutting surfaces which are opposed to each other and which move toward each other while removing material from the workpiece. As a result of the above rotary movements with the above axes which are perpendicular to each other, a spherical body is formed from the workpiece, with material being removed from the workpiece at the end edges of the tools.

However, with this known method and apparatus it is always required that the workpiece be supported for rotation about a predetermined axis. This requirement of rotating the workpiece is extremely inconvenient and time-consuming, while at the same time as a result of this requirement there unavoidably remains at the finished body a through-passage or one or more openings necessitated by the structure for mounting the workpiece for rotation.

SUMMARY OF THE INVENTION

It is accordingly a primary object of the present invention to provide a method and apparatus which will avoid drawbacks of the type inherent in previously known methods and apparatus for manufacturing solid bodies by removing material from workpieces.

In particular, it is an object of the present invention to provide a method and apparatus which will enable bodies to be manufactured by removal of material from a workpiece with the resulting bodies having no indentations, openings, or the like, resulting from the necessity of gripping the workpiece and rotating the latter during removal of material therefrom.

In addition it is an object of the present invention to provide a method and apparatus which are inexpensive while at the same time achieving a high output.

Also it is an object of the present invention to provide a method and apparatus which are relatively simple and reliable.

Thus, one of the important objects of the present invention is to provide a method and apparatus according to which it becomes possible to achieve from workpieces, by removal of material therefrom, finished bodies which have smooth uniform exterior surfaces.

According to the invention, the workpiece is freely situated between a pair of tools which are simultaneously rotated in opposite directions while removing material from the workpiece, these tools respectively having hollow interiors defined by material-removing surfaces thereof and respectively conforming to halves of the final finished body, so that as material is removed from the workpiece the final finished body becomes almost entirely enclosed within a space defined by the hollow interiors of the tools. The workpiece which is situated between the tools can take the form of an elongated bar which can be fed in a stepwise manner between the tools during successive operating cycles, so as to achieve in this way a substantially automatic manufacture of a series of bodies from such an elongated bar. However, it is also possible to situate between the tools workpieces in the form of separate plates or blocks such as square blocks, for example.

It thus becomes possible with the method and apparatus of the invention to achieve bodies which have perfectly smooth exterior surfaces which are entirely free of any indentations. The method and apparatus of the invention operate in a semi-continuous manner and in operating cycles which require only an extremely short time so as to enable bodies of the most widely varying configurations to be manufactured in an economical manner with a relatively small amount of material removed from the workpieces. The bodies which are formed with the method and apparatus of the invention can have the configuration of rings or spheres, although they also can have an egg-shaped or oval configuration.

The solid bodies are manufactured with tools which have hollow interiors defined by material-removing surfaces and having a configuration corresponding to the final configuration of the finished solid bodies. Thus, the hollow interiors of the tools, may, for example, be of a hemispherical configuration, and at their hollow interiors the tools have raised teeth similar to file teeth for the purpose of removing material from a workpiece. Instead of having a hemispherical configuration it is also possible for the hollow interiors of the tools to have an elliptical, parabolic, or other configurations depending upon the desired shape of the bodies which are to be manufactured. The tools are provided with openings extending from the hollow interiors to the exterior of the tool so as to afford in this way the possibility of discharging from the interiors of the tools material which is removed from the workpiece.

The tools also have end faces provided with material-removing surfaces which may be in the form of raised teeth similar to file teeth.

Thus, by way of the apparatus of the invention it is possible to form bodies either from separate plates or blocks or from an elongated bar which is fed in a stepwise manner to the space between a pair of tools after each body is formed thereby.

Thus, the solid bodies which are formed by way of the present invention have surfaces of revolution which are completely smooth since it is unnecessary to grip and support the workpiece while it is worked on. Instead the workpiece simply is situated freely between the tools, in accordance with the present invention, and thus the exterior surface of the finished body is free of any indentations or through-passages or the like which would be required if it were necessary to support the workpiece by a suitable structure during removal of material therefrom.

At the same time, it is possible to achieve with the invention a rapid clean operation during which a relatively small amount of material is removed so that the operating costs in connection with the present invention are small, with a reliable production operation being assured with the present invention simply by way of a pair of rotating tools.

Inasmuch as it is possible to provide a quasi-continuous operation according to which an elongated workpiece in the form of a bar can be fed in a stepwise manner to the space between the tools after each body is formed from such a workpiece, the method of the present invention is particularly economical. Moreover, because the material-removing surfaces of the tools of the invention cover a relatively large area while at the same time they are only required to remove a relatively small amount of material from a workpiece, the tools of the invention will have a long operating life.

The bodies manufactured by way of the method and apparatus of the present invention can have any configuration which can be achieved by rotation of the tools. Thus, instead of bodies of a full circular configuration, such as spherical, elliptical, or cylindrical bodies, it is also possible to provide ring-shaped solid bodies the cross section of which can be triangular, rectangular, circular, or even of more complex configurations such as, for example, of an hourglass or figure 8 configuration.

BRIEF DESCRIPTION OF DRAWINGS

The invention is illustrated by way of example in the accompanying drawings which form part of this application and in which.

DESCRIPTION OF PREFERRED EMBODIMENTS

Figures 1, 4, 5:
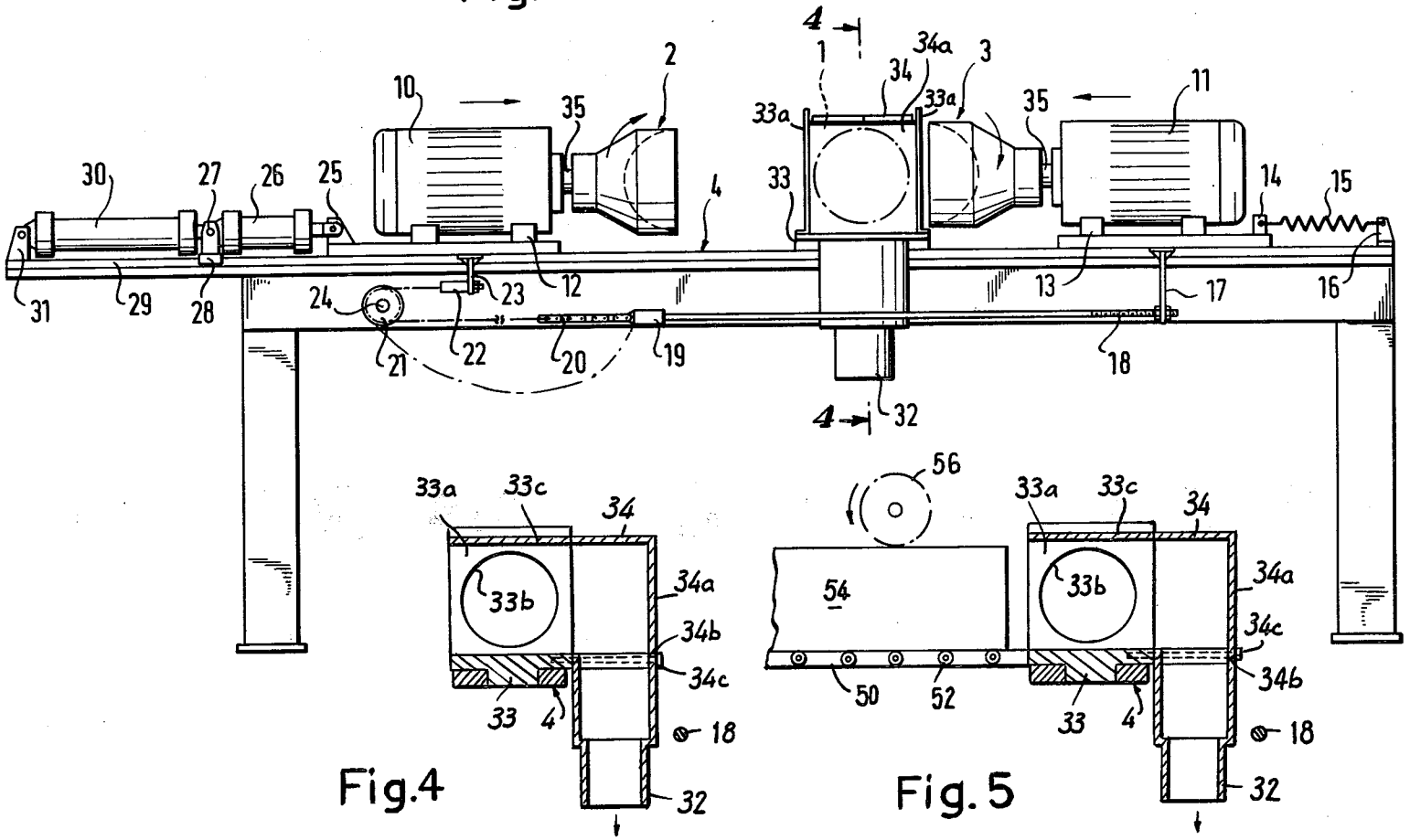
FIG. 1 is a schematic elevation of one possible apparatus of the invention for practicing the method of the invention.
FIG. 4 is a transverse sectional elevation taken along line 4—4 of FIG. 1 in the direction of the arrows and showing a suction housing and work-supporting structure of the invention.
FIG. 5 is a sectional elevation of another embodiment of the structure shown in FIG. 4, the embodiment of FIG. 5 being adapted to handle workpieces different from those which can be handled with the embodiment of FIG. 4.

Referring now to FIG. 1, there is illustrated therein a left tool means 2 which is operatively connected with a suitable means for supporting, driving, and feeding this tool means 2. Thus, the means operatively connected with the tool means 2 includes the illustrated motor 10 which is operatively connected by way of its output shaft 35 with to tool 2 so as to rotate the latter about its axis while at the same time supporting the tool means 2. In much the same way a right tool means 3 is driven and supported by the output shaft 35 of the motor 11 which is shown in FIG. 1. These motors 10 and 11 are connected to any suitable source of energy and are operatively connected with the tools 2 and 3 so as to simultaneously rotate the latter in opposite directions, as indicated by the arrows in FIG. 1. It is to be noted that the shafts 35 as well as the tools 2 and 3 carried thereby all have a common central axis and it is about this axis that the tools 2 and 3 are simultaneously rotated in opposite directions.

The means operatively connected to the tool means 2 includes not only the motor 10 but also a carriage 12 which supports the motor 10. In the same way the carriage 13 supports the motor 11. This means operatively connected to the tool means 2 and 3 also includes a common support 4 which carries the carriages 12 and 13. This common support 4 is in the form of a suitable bed provided with guides which guide the carriages 12 and 13 for movement toward and away from each other in a straight line parallel to the common axis of the tools 2 and 3. The support 4 may include suitable ball bearings which guide the carriages 12 and 13.

The carriage 13 fixedly carries at its right end, as viewed in FIG. 1, a lug 14 to which one end of the spring 15 is connected, this spring 15 also being connected to a stationary lug 16 fixedly carried by the support 4 at the right end of the latter, as viewed in FIG. 1. Thus, it will be seen that the lug 16 is situated at that end of the support 4 which is directed away from the tool 3.

The carriage 13 also carries laterally beyond the support 4 a rigid bracket or rod 17 which is fixed to and extends downwardly from the carriage 13. This member 17 is fixed to one end of an elongated rod or spindle 18. Thus, the right end of the spindle 18 is threaded and passes through an opening in the bracket 17 while carrying a pair of nuts on opposite sides of the bracket 17 so that the longitudinal position of the rod 18 can be adjusted.

At its left end, as viewed in FIG. 1, the elongated rod or spindle 18 is fixed with a holder 19 to which one end of a flexible chain 20 is connected. This chain 20 has a slack portion which extends around a sprocket wheel 21 supported for free rotation by a stationary pin 24 which is fixed to and projects from the support 4 in a manner shown in FIG. 1. The chain 20 extends around the sprocket 21 and terminates at a sleeve 22. Thus the chain 20 is fixed to the sleeve 22 which in turn is fixed to a bracket 23 which is fixed to and extends downwardly from the carriage 12, this bracket 23 also being situated laterally beyond the support 4. When the tool 2 is situated at the position shown in FIG. 1, the chain 20 will be slack as schematically indicated in FIG. 1. However when the carriage 12 together with the motor 10 and tool 2 are advanced to the right, as viewed in FIG. 1, the slack in the chain 20 is taken up, and just before the tool 2 reaches the vicinity of the work-supporting table 33, the chain will become taut as also indicated in dot-dash lines in FIG. 1. The sprocket wheel 21 is supported by a suitable ball bearing on the shaft 24.

The movement of the carriage 12 is brought about by way of a lug 25 which is fixed to and extends upwardly from the left end region of the carriage 12, as viewed in FIG. 1. This lug 25 is pivotally connected with the free end of a piston rod which projects from a cylinder 26 which is adapted to have fluid under pressure supplied to and withdrawn therefrom in any suitable way. Thus the piston whose piston rod is connected to the lug 25 will move in one direction or the other within the cylinder 26 so as to displace the carriage 12 accordingly.

The cylinder 26 is itself pivotally connected to an intermediate support 27 carried by a relatively small guide or carriage 28 which is guided by way of a guide rail 29 which extends parallel to the common axis of the tools 2 and 3 and which is fixedly carried by the support 4. The rail 29 is preferably provided with ball bearings for supporting the guide member 28 for movement therealong.

The support 27 is also pivotally connected with the free end of a piston rod whose piston is situated in the cylinder 30 which it will be noted is longer than the cylinder 26, this cylinder 30 itself being pivotally connected to a lug 31 which is fixed and extends upwardly from the left end of the guide rail 29, as shown in FIG. 1. The operating cylinders 26 and 30 are preferably arranged in such a way that they have operating strokes of different magnitudes. Thus the operating stroke of the cylinder 26 is shorter than that of the cylinder 30.

In line with but slightly lower than the space between the tools 2 and 3 is the work-supporting table 33 which has been referred to above. This table 33 is supported by the support 4 in the manner shown schematically in FIG. 4. The table 33 is fixed with a pair of upright walls **33*a* which are respectively formed with circular openings 33*b* the centers of which are situated in the common axis of the tools 2 and 3. The tools 2 and 3 can pass through these openings 33*b* so as to enter into the space between the walls 33*a* and at the same time the outer peripheral surfaces of the tools 2 and 3 can be guided and can have sliding contact with the edges which define the openings 33*b***.

The upright walls **33*a* are fixed with a horizontal upper wall 33*c* which extends between these walls 33*a* so as to make them relatively rigid with respect to the table 33. The table 33 together with the upright walls 33*a* and the upper wall 33*c* form part of a suction housing means which includes the housing portion 34 which is fixed to the table 33 in the manner apparatus from FIGS. 1 and 4. Thus, the portion 34 of the suction housing has a top wall forming an extension of the wall 33*c* and side walls forming extensions of the side wall 33*a*, and in addition the portion 34 of the suction housing means has an end wall 34*a* extending between and connected to the side and top walls of the suction housing portion 34, this suction housing portion also including a bottom wall 34*b* which is fixed to the table 33 in any suitable way such as by suitable bolts 34*c*. This bottom wall 34*b* is formed with an opening situated at the top end of a downwardly directed pipe 32 which is fixed in any suitable way to the housing portion 34 and which can be connected through a flexible hose or the like to a suitable source of suction. In this way the suction housing portion 34 together with the table 33 and the upright walls 33*a* and top wall 33*c*** form a suction housing means the interior of which communicates with a source of suction so that material removed from a workpiece can be displaced by suction out of the interior of the suction housing means. Thus, the chips or the like resulting from removal of the material from a workpiece, as well as any dust which might otherwise be formed in the surrounding atmosphere are removed by way of the suction housing means.

At its left end, as viewed in FIG. 4, the suction housing means is open, so that a workpiece can be introduced into the space between the walls **33*a*, while simply resting on the table 33 which thus serves as a guide for the work, this table 33 guiding the work for movement normal to the plane of FIG. 1 in a direction transverse to the common axis of the tools 2 and 3**.

With an embodiment as shown in FIG. 4, it is possible to introduce into the space between the walls **33*a* a block of material suitable to be worked upon by the tools 2 and 3. However it is also possible to provide an arrangement as shown in FIG. 5. Thus in FIG. 5 it will be seen that the table 33 has rigidly fixed thereto a pair of elongated bars 50, one of which is shown in FIG. 5. A plurality of rollers 52 are supported for free rotation between the bars 50, and the highest parts of the rollers 52 are situated at the same elevation as the top surface of the table 33. With this embodiment it is possible to support on the rollers 52 an elongated bar 54 which forms the workpiece, an upper roller 56 which is shown schematically in FIG. 5 being in frictional engagement with the top surface of the bar 54. At suitable intervals this friction roller 56 is turned in a counterclockwise direction, as shown by the arrow in FIG. 5, so as to feed the right portion of the bar 54 into the space between the walls 33*a* and along the top surface of the table 33. Thus with this arrangement it is possible after one body is formed by the tools 2 and 3 from a right end portion of the bar 54, as viewed in FIG. 5, to feed this bar 54 through a suitable increment so as to situate the next portion thereof in line with and extending across the openings 33*b* so that the next body can be formed from the bar 54, and in this way a semi-continuous operation can be achieved for providing a plurality of bodies from a bar 54**.

In addition it will be noted that because the tools 2 and 3 are guided by the edges which define the openings **33*b* through which these tools extend, a precise vertical as well as horizontal alignment of the tools 2 and 3 is achieved and absolute coincidence between the central axes of the tools 2 and 3 is assured during operation of the tools 2 and 3** on a workpiece.

Figure 2:
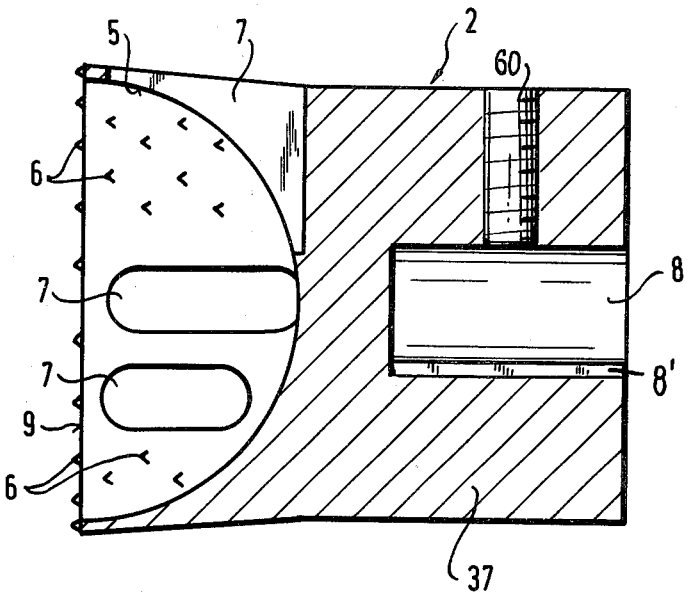
FIG. 2 is a sectional elevation of one possible embodiment of a tool according to the invention.

FIG. 2 illustrates one possible embodiment of the tool means 2, and it will be understood that the tool means 3 is of an identical construction. In the particular example illustrated in FIG. 2 the tool means 2 is adapted to form one half of a spherical body. The tool 2 has a solid body portion 37 which is formed with the hollow interior of hemispherical configuration defined by the hemispherical material-removing surface 5 of the tool 2. Thus the tool 2 is open at its left end, as viewed in FIG. 2, and from this left end of the tool 2 the hollow interior defined by the surface 5 projects inwardly. The surface 5 includes a multiplicity of raised teeth 6 similar to file teeth so as to provide for the surface 5 the material-removing capability. Thus the entire surface 5 is covered with the teeth 6.

In addition, the tool 2 has an end face 9 which surrounds the hollow interior surface 5 and is situated in a plane normal to the central axis of the tool 2. This end face 9 also has teeth 6 as shown in FIG. 2.

According to a further feature of the invention, the tool 2, and thus also the tool 3, is formed with a plurality of openings 7. Each opening 7 extends from the hollow interior of the tool of the exterior thereof in a manner apparent from FIG. 2. These openings 7 are preferably arranged in four pairs in the manner illustrated in FIG. 2, so that each tool has eight openings 7. Thus it will be seen that the openings 7 are in the form of slots which extend longitudinally in a direction parallel to the central axis of the tool 2. Moreover, the openings 7 are situated so as to extend substantially radially with respect to the axis of the tool 2, thus forming radial passages through which material removed from the work by the teeth 6 can travel to the exterior of the tool.

At its rear end the portion 37 of the tool is formed with the bore 8 which receives the shaft 35, the latter carrying a key, for example, which is received in the keyway 8' shown in FIG. 2. In addition the portion 37 is formed with a radial internally threaded bore receiving a set screw 60, so that in this way the tool 2 can be fixed to the shaft 35 for rotation therewith, and of course the tool 3 is fixed in the same way to the shaft 35 of the motor 11.

Of course, the tools can be fixed in any other suitable way to the shafts of the motors for rotation with these shafts. For example the tools can be threaded onto these shafts, and a splined connection can also be provided with a set screw such as the set screw 60 being provided in order to prevent axial movement of the tool with respect to the shaft 35.

Figure 3:
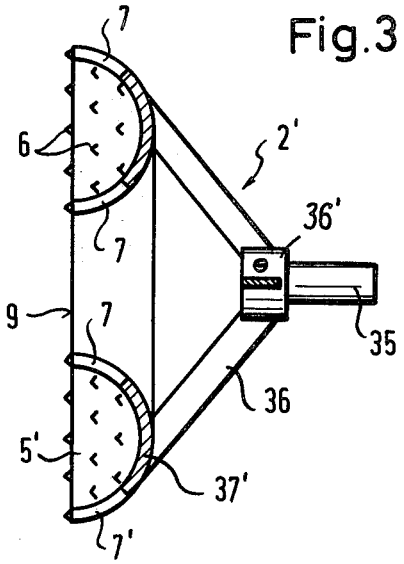
FIG. 3 is a sectional elevation of another possible embodiment of a tool according to the invention.

While tools such as the tools 2 and 3 will form a body of a full circular configuration which in the example illustrated in FIG. 2 will be a hemispherical configuration, it is also possible to provide tools which will manufacture ring-shaped bodies, and such a tool 2' is illustrated in FIG. 3. Thus the tool 2' includes a circular shell 37' which is of semicircular cross section and which has a wall thickness which is suitably reduced as compared to the thickness of the body 37 of the tool of FIG. 2. This shell or circular channel 37' which is of semicircular cross section is fixed to the outer ends of a plurality of inclined bars 36 the inner ends of which are fixed to a sleeve 36' which is fixed to the shaft 35 in any suitable way such as that referred to above in connection with the body 37 of the tool 2 of FIG. 2. Thus the bars 36 form a substantially rigid support for the shell 37'. This shell 37' is also formed with a plurality of slots 7' through which removed material can flow to the exterior of the shell 37'. The interior of the shell 37' is defined by the inner material-removing surface 5' which is also provided with the raised teeth 6 which may be identical with the teeth 6 of FIG. 2, and in this case also the end edges 9 have teeth 6. The outer periphery of the shell 37' as well as the outer periphery of the end face 9 of the tool of FIG. 2 will slidably pass through the opening **33*b* to be precisely guided thereby, although during actual cutting away of material from a workpiece these portions 9' will become situated inwardly beyond the walls 33*a* between the latter so that the guiding provided by way of the openings 33*b* is achieved only during the initial entry of the pair of tools into the space between the walls 33*a***.

Although the shell 37' is shown in FIG. 3 as having a semicircular cross section, any other suitable cross section can be provided such as a triangular cross section, a trapezoidal cross section, the cross section of half of an elipse, or the shell 37' may have the cross section of a pair of hemispheres situated one next to the other to achieve in this way a body of hourglass or figure-8 configuration.

The above-described apparatus of the invention operates, according to the method of the invention, in the following manner:

A workpiece 1, as schematically shown in FIG. 1, is situated in the suction housing means in the above-described manner on the surface of the table 33. Thus, this workpiece 1 may take the form of a simple block or plate which can be formed into a spherical body, as shown schematically in dot-dash lines in FIG. 1, by tools such as the tools 2 and 3, or the workpiece may take the form of the bar 54 shown in FIG. 5 and described above. In either event, it is only required that the workpiece be large enough to extend completely across the hollow interior of the tool means 2 or 3. Thus when the workpiece in the form of a suitable block, plate or bar rests on the surface of table 33, the upper surface of the workpiece should be situated at an elevation at least as high as the uppermost part of the tool means, whether this tool means be in the form shown in FIG. 2 or in the form shown in FIG. 3. Thus, the workpiece is fed to the position to be worked upon by the tool means in a direction transverse to the common axis of the pair of tool means. It is to be noted that while the workpiece should be large enough to extend completely across the hollow interiors of the pair of tool means, at the same time in at least one direction, such as the vertical direction, the dimension of the workpiece is only slightly larger than the final outer dimension of the finished body so that the amount of material which must be removed can be reduced to a minimum. Of course, while the vertical dimension has been referred to above, the horizontal dimension of the workpiece, in the direction of the common axis of the pair of tool means, should also preferably only be slightly larger than the corresponding dimension of the finished body so as to reduce in this way also the extent of material which must be removed. Thus, with tools such as those shown in FIGS. 1 and 2, the vertical dimension and the horizontal dimension of the workpiece, in the direction parallel to the common axis of the tools, is only slightly larger than the radius of the spherical body which will be formed, whereas with the tool as shown in FIG. 3, the vertical dimension need only be slightly larger than the outer diameter of the channel 37' while the horizontal dimension of the workpiece in a direction parallel to the axis of the shaft 35 shown in FIG. 3 need only be slightly greater than twice the radius of the semicircular interior cross section of the channel 37'. Thus when operating with tools of the type shown in FIG. 3, the workpiece can take the form of a suitable plate.

With a suitable workpiece thus situated on the table 33, the tools 2 and 3 together with the driving motors 10 and 11 thereof are fed toward each other so that they can cut into the workpiece. With the arrangement shown in FIG. 1 where the chain 20 is initially slack, the length of the chain 20 is such that the tool 2 together with the motor 10 thereof and the carriage 12 will be advanced by feeding fluid under pressure to the cylinders 26 and 30 until the tool 2 is situated at a distance from the left wall **33*a* of FIG. 1 which is substantially equal to the distance of tool 3 from the right wall 33*a* of FIG. 1. At this time the chain 20 has become taut, and then during the continued advance of the tool 2 to the right, as viewed in FIG. 1, through the chain 20 which travels around the sprocket 21 as well as through the rod 18 and the bracket 17 the tool 3 together with its motor 11 and carriage 13 are advanced to the left, in opposition to the spring 15 which becomes tensioned. Thus, the distance between the pair of tools is reduced while the tools come into engagement with the workpiece carried by the table 33. It will be noted that the workpiece is completely free to center itself between the tools, since it is not confined in any way, and if necessary it is even possible for the table 33 to shift along the guides formed by the support 4, in the manner apparent from FIGS. 4 and 5, so that the workpiece is completely free to become automatically centered between and simultaneously engaged by the pair of tools 2 and 3**.

With the end faces 9 of the tools 2 and 3 engaging the opposed side surfaces of the workpiece, or even before the tools come into engagement with the workpiece, the tools 2 and 3 are simultaneously rotated by their driving motors 10 and 11 in opposite directions at equal speeds about their common axis. As a result, the pair of tool means exert equal and opposite forces on the workpiece and these equal and opposite forces cancel each other. Thus, the turning moment exerted on the workpiece by one of the tool means is exactly opposed by the turning moment exerted on the workpiece by the other tool means, and thus there is no tendency of the rotating tools to turn the workpiece and thus there is no pressing of the workpiece by either one of the tool means downwardly against the table 33 so that the latter need not absorb any particularly large load.

Simultaneously with the equal and opposite rotation of the pair of tool means, the distance therebetween is gradually reduced by equal and opposite feeding of the pair of tool means toward each other along their common axis. This equal and opposite feeding is achieved by the supply of fluid under pressure to the cylinders 26 and 30 and by way of the transmission between the carriages 12 and 13, this transmission including the chain 20 and rod 18 as described above. Thus, the pair of tool means will gradually approach each other while removing material from the workpiece. During this removal of material from the workpiece, the source of suction which communicates with the interior of the suction housing means described above is rendered operative, so that air enters into the suction housing means through the left end thereof, as viewed in FIGS. 4 or 5, and flows downwardly through the pipe 32, this flow of air carrying away any chips, dust, or the like formed by the material removed from the workpiece. Of course, the rotating tools 2 and 3 also permit removed material to travel through the openings 7 thereof, and since these openings 7 rotate with the tools, in the passages formed by the openings 7 the material is also removed by way of centrifugal force. Thus, the rotating passages will throw the material centrifugally toward the exterior of the tools to be received in the suction housing means from where the removed material is withdrawn by suction.

As the pair of tool means approach closer and closer toward each other, they form between themselves a circular rib interconnecting the part of the workpiece situated in the hollow interiors of the tool means with the part of the workpiece situated outside of the tool means, and this circular rib, or pair of ribs in the case of a tool as shown in FIG. 3, constantly diminishes in thickness as the pair of tool means approach each other. It will be noted from FIG. 2 that the body 37 of the tool tapers slightly from its left end surface 9, and of course the same is true because of the semicircular cross section of the channel 37 of FIG. 3, so that in this way the tools of the invention have the required draft or clearance at their outer surface which will prevent the outer surfaces of the tools from frictionally rubbing against the part of the workpiece which is situated at the exterior of the tool.

As the above circular rib of the workpiece, situated between the end faces of the pair of tools, becomes of a gradually smaller thickness, the moment is reached when the teeth 6 at the end surfaces 9 of the pair of tool means pierce through the rib which at this time is extremely thin, and precisely at this moment when the extremely thin circular rib is pierced through by the teeth 6 the feeding of the pair of tool means toward each other is terminated and instead the pair of tool means are moved apart from each other. Thus, a suitable switch can be adjustably supported on the support 4, and the position of this switch is adjusted so that it will be actuated by the carriage 12 at the moment when the teeth 6 at the end faces 9 of the tools pierce through the rib. This switch when actuated can operate a solenoid which will change the position of a valve controlling the flow of pressure fluid to the cylinders 26 and 30, and upon thus changing its position the valve will cause pressure fluid to be withdrawn so that the carriage 12 now move to the left, as viewed in FIG. 1, while the spring 15 is free to contract and pull the carriage 13 to the right, as viewed in FIG. 1. Of course, the flow of pressure fluid may be such that its direction of flow into and out of the cylinders 26 and 30 is simply reversed.

Experience has shown that upon moving of the pair of tool means apart from each other, the finished, or almost finished, body formed from the workpiece remains in contact with the tool means 2 which is connected to the motor 10 carried by the carriage 12 which is positively moved by way of the fluid-pressure means 26, 30. Of course, due to the rotation of the tools 2 and 3 the centrifugal force in the openings 7 will create a certain amount of suction tending to hold the finished body in the interiors of the tools, and of course this suction is enhanced by the suction prevailing in the suction housing means. Upon a reversal in the direction of feed of the carriage 12, the tool 2 will tend initially to move away from the tool 3 because of a slight lag or delay in the contraction of the spring 15, and thus the finished workpiece will remain with the tool 2.

In the above example where both of the tools 2 and 3 are rotated in opposite directions at constant speeds, the finished body which remained stationary while engaging both tools, is set into rotation by the tool 2 so as to assume the speed of rotation of the tool 2. Because this initially stationary body is brought up to the speed of rotation of the tool 2, there is a slippage between the finished body and the tool 2, and this slippage serves automatically to remove from the body the relatively thin rib or burr projecting from its exterior surface, so that a completely smooth exterior surface free of burrs is automatically achieved. The piston in the cylinder 30 completes its reverse stroke after the piston in the cylinders 26 completes its reverse stroke, and at this time when the reverse stroke of the piston in the cylinder 30 has been completed, a suitable ejection device operates on the body held by the tool 2 so as to eject this body therefrom. The ejected finished body can be received on a suitable conveyer belt, chute, or the like, so as to be conveyed to a collecting location where the finished bodies are collected.

In the meantime, upon retraction of the tools from the interior of the suction housing means, the next workpiece is supplied thereto or the bar 54 is fed to the right, as viewed in FIG. 5, so that the above cycle can be immediately repeated to form the next finished body.

According to a further embodiment of the invention the pair of tools 2 and 3 can be braked so as to have their rotation terminated at the instant when they come together with the teeth 9 at the end surfaces of the tools piercing through the residual rib or burr. Then, without the tools rotating, they are displaced apart from each other and the finished body can be removed.

As an ejection device it is preferred to use one or more nozzles which supply a jet or stream of air under pressure to flow through the openings 7 into the interior of the tool 2 not only to eject the finished body therefrom but also to clean the finished body of any chips or other removed material which might still cling to the surface of the finished body.

Any portions of the workpiece which break away from the finished body at the exterior of the tools are automatically sucked out of the suction housing. Where the workpiece is an elongated bar, portions which initially remain connected therewith from the preceding finished body simply break off from the bar and are sucked out of the suction housing when the bar is advanced.

What is claimed is:

1. In a method for manufacturing a solid body of full circular or ring-shaped configuration, the steps of situating between a pair of material-removing tools a workpiece the material of which is to be removed by said tools, the latter having concave hollow interiors having a common central axis and annular surfaces surrounding said hollow interiors located in a plane extending substantially transversely to said common central axis, said hollow interior and annular surfaces being provided with cutting teeth defining material-removing surfaces, said tools being adapted to move toward each other until said annular surfaces on the respective tools are substantially contiguous to each other, said hollow interiors being formed to thereupon define a hollow space substantially corresponding to the configuration of the solid body to be manufactured, said workpiece initially being large enough to extend across the entire hollow interiors of both tools while situated therebetween, and placing the workpiece in engagement with both of said tools while simultaneously rotating said tools in opposite directions about their common axis and while simultaneously reducing the distance between said tools until said annular surfaces are substantially contiguous to each other so that as the material of the workpiece is removed by said surfaces of said tools said workpiece will assume a configuration determined by the configuration of said tool surfaces, terminating the reduction in the distance between said tools when a body formed by said surfaces thereof has become substantially fully enclosed between said surfaces of said tools, and then increasing the distance between said tools so that the finished body formed thereby can be removed.

2. In a method as recited in claim 1 and wherein said surfaces of said tools are mirror images of each other, feeding said tools equally and oppositely toward each other along said common axis for reducing the distance therebetween while simultaneously rotating the tools at equal speeds but in opposite directions.

3. In a method as recited in claim 1 and wherein the workpiece initially is in the form of a block which is situated between said tools.

4. In a method as recited in claim 1 and wherein the workpiece is initially in the form of an elongated bar one end region of which is situated between said tools so that the latter form said body from said one end region of said bar, and after one body is finished and the distance between said tools has been increased, displacing said bar transversely to said common axis toward the space between said tools to situate another portion of said bar between said tools, and repeating the above steps for forming a series of said bodies from said bar.

5. In a method as recited in claim 1 and wherein said workpiece remains stationary while material is removed therefrom by said tools, the latter providing at said workpiece while removing material therefrom substantially equal and opposite forces which cancel each other, and the finished body remaining in engagement with one of said tools when the distance therebetween is increased after the substantially finished body has been almost completely enclosed in the space defined by the hollow interiors of said tools, and continuing the rotation of at least said one tool with which the substantially finished body remains in contact while the distance between the tools is increased.

6. In a method as recited in claim 1 and including the step of terminating the rotation of said tools when the body formed thereby from said workpiece has become substantially entirely enclosed in the hollow interiors of said tools.

7. In an apparatus for forming solid bodies of full circular or ring-shaped configuration by removing material from a workpiece, a pair of tool means for removing material from a workpiece, each of said tool means being formed with a concave hollow interior space, said interior spaces having a common central axis, and an annular surface surrounding said hollow interior located in a plane extending substantially transversely to said common central axis, said hollow interior and annular surface both being provided with cutting teeth, capable of removing material from a workpiece when moved with respect thereto while pressing thereagainst, said tool means being adapted to move toward each other until the annular surfaces on the respective tools are substantially contiguous to each other, said hollow interiors being formed to thereupon define a hollow space substantially corresponding to the configuration of the solid body to be formed, and operating means operatively connected with both of said tool means for supporting the latter with their central axes coinciding with each other and with their hollow interiors facing each other, said operating means also being operatively connected with said pair of tool means for simultaneously rotating the same in opposite directions about their coinciding central axes and for reducing the distance between the pair of tool means while a workpiece is situated therebetween until said annular surfaces are substantially contiguous to each other to form a body of predetermined configuration from a workpiece.

8. The combination of claim 3 and wherein each tool means is formed with a plurality of openings each extending from the hollow interior of each tool means to an exterior surface thereof for providing communication between the hollow interior of each tool means and the exterior thereof, so that material removed from a workpiece by each tool means can travel through said openings to the exterior of the tool means.

9. The combination of claim 7 and wherein a suction housing means is situated between said pair of tool means for receiving a workpiece while the latter has material removed therefrom by said tool means, and said suction housing means being adapted to be connected with a source of suction for removing from the interior of said suction housing means material which has been removed from a workpiece by said pair of tool means.

10. The combination of claim 7 and wherein said operating means operatively connected to said pair of tool means includes a common supporting structure for both of said tool means.

11. The combination of claim 7 and wherein said operating means which is operatively connected to said pair of tool means is capable of simultaneously rotating the pair of tool means at constant speeds.

12. The combination of claim 7 and wherein said operating means operatively connected to said pair of tool means includes a common support for both of said tool means and is operatively connected to said pair of tool means for moving the latter through different distances along said common support.

13. The combination of claim 7 and wherein the hollow interior of each tool means has a hemispherical configuration.

14. The combination of claim 7 and wherein the hollow interior of each tool means is of a ring-shaped configuration.

* * * * *